US006415967B1

(12) United States Patent
Toaldo

(10) Patent No.: US 6,415,967 B1
(45) Date of Patent: Jul. 9, 2002

(54) CLOSURE PLATE AND A SLIDE GATE ON THE OUTLET OF CONTAINER CONTAINING MOLTEN METAL

(75) Inventor: Walter Toaldo, Zug (CH)

(73) Assignee: Stopinc Aktiengesellschaft, Hünenberg (CH)

( * ) Notice: Subject to any disclaimer, the term of this patent is extended or adjusted under 35 U.S.C. 154(b) by 0 days.

(21) Appl. No.: 09/646,414

(22) PCT Filed: Mar. 17, 1999

(86) PCT No.: PCT/CH99/00119

§ 371 (c)(1),
(2), (4) Date: Nov. 3, 2000

(87) PCT Pub. No.: WO99/47296

PCT Pub. Date: Sep. 23, 1999

(30) Foreign Application Priority Data

Mar. 17, 1998 (CH) ..... 634/98

(51) Int. Cl.[7] ..... B22D 41/08
(52) U.S. Cl. ..... 222/600; 222/597
(58) Field of Search ..... 222/597, 600, 222/591, 594, 590; 266/236

(56) References Cited

U.S. PATENT DOCUMENTS

| | | | | |
|---|---|---|---|---|
| 4,327,847 A | * | 5/1982 | Tinnes | 222/600 |
| 5,074,442 A | * | 12/1991 | Fricker | 222/600 |
| 5,139,237 A | * | 8/1992 | Fricker | 222/600 |
| 5,251,794 A | * | 10/1993 | Toaldo | 222/600 |

FOREIGN PATENT DOCUMENTS

| | | |
|---|---|---|
| DE | 44 33 356 | 3/1996 |
| FR | 2 369 042 | 5/1978 |
| GB | 2 213 412 | 8/1989 |

* cited by examiner

*Primary Examiner*—Scott Kastler
(74) *Attorney, Agent, or Firm*—Wenderoth, Lind & Ponack, L.L.P.

(57) ABSTRACT

A valve plate for a sliding gate valve has a refractory plate and a metal shell surrounding it. Associated with the plate is a centering device which is preferably constituted by two abutment surfaces, which are arranged at a defined spacing from one another and which rise up substantially and at least partially perpendicular towards a plate support constituted by a metal shell and have a thickness substantially equal to the metal shell thickness. These abutment surfaces are so arranged that, in an inserted and centered state of the plate, they engage correspondingly shaped abutment surfaces on a metal frame. The plate may, thus, be manufactured simply and economically.

20 Claims, 3 Drawing Sheets

CLOSURE PLATE AND A SLIDE GATE ON THE OUTLET OF CONTAINER CONTAINING MOLTEN METAL

BACKGROUND OF THE INVENTION

1. Field of the Invention

The invention relates to a valve plate for a sliding gate valve at the outlet of a vessel containing molten metal. The invention includes a refractory plate, a metal shell surrounding the refractory plate, and centering means which is so constructed that the valve plate may be inserted loosely in a metal frame of the sliding gate valve and centered therein, at least in a direction of movement. The invention also relates to a sliding gate valve for the valve plate.

2. Description of the Related Art

A mentioned refractory valve plate according to GB-A-2 213 412 has a centering means, which is shaped as a cylindrical surface formed by a metal can or a bandage concentrically arranged around a flow through. This cylindrical surface is formed to radiate outward and is machined so that the plate can be engaged with substantially no free play within a metal frame. With this kind of centering, it is necessary that such an outward surface is provided. As a result, the shape of the plate can be only altered in a limited fashion.

In a known sliding nozzle plate disclosed in the publication DE-A-44 33 356, a metal housing, which surrounds a plate from below and laterally, has one or a number of projections which fit into corresponding recesses in the metal frame. In the inserted state of the plate, its projections are retained with a lateral clearance in the range between 0.1 and 1 mm in a direction of movement of the plate. These projections must, therefore, be provided with a very narrow tolerance and are correspondingly expensive to produce.

SUMMARY OF THE INVENTION

Against this background, it is an object of the present invention to provide a valve plate of the type mentioned above which, with precise centering in a metal frame, may be manufactured simply and economically. This valve plate is also to be so dimensioned that the space requirement when such plates are stacked is thereby maintained at a minimum and the risk of damage to this centering means or a centering device can be eliminated to the greatest extent possible.

This object is solved in accordance with the invention if the centering means or centering device is constituted by preferably two abutment surfaces arranged at a defined spacing from one another which rise up substantially, at least partially, vertically towards a plate support afforded by a metal shell and having a thickness approximately the same as the metal shell thickness. These abutment surfaces being so arranged that, in the inserted and centered state of the plate, they engage correspondingly shaped abutment surfaces on the metal frame.

This valve plate may be manufactured simply with its construction in accordance with the invention and such a centering in a metal frame of the sliding gate valve is, however, nevertheless ensured with it, such that it can be used in an extremely operationally secure manner.

BRIEF DESCRIPTION OF THE DRAWINGS

Exemplary embodiments and further advantages of the invention will be explained in more detail with reference to the drawings, in which.

DETAILED DESCRIPTION OF THE INVENTION

Figure 1:
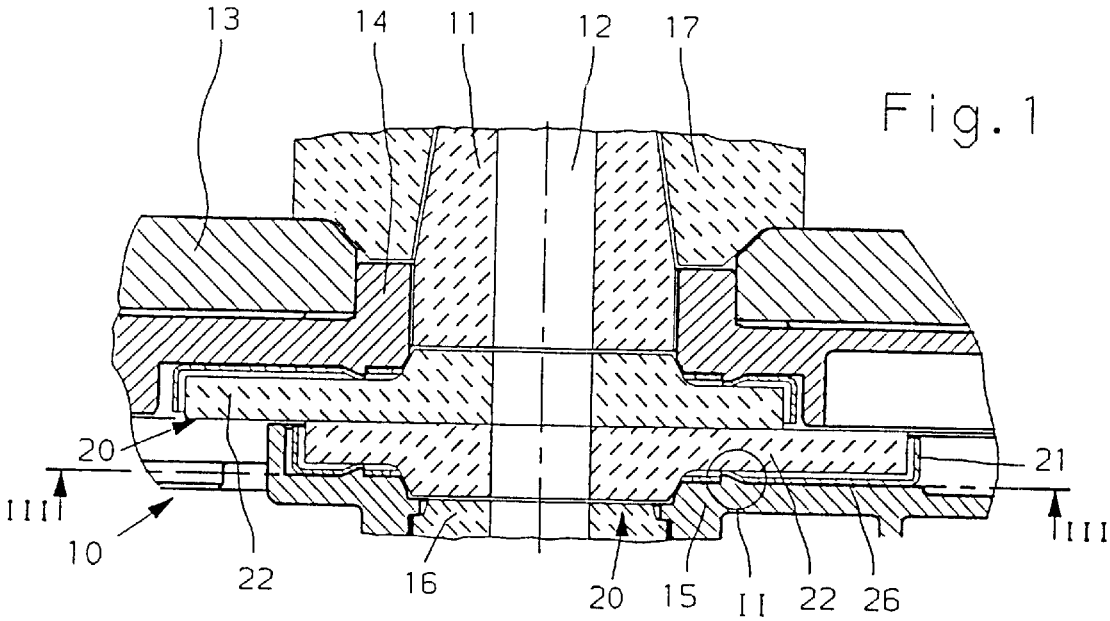
FIG. 1 is a longitudinal sectional view of a sliding gate valve illustrated in part with valve plates in accordance with the invention.

FIG. 1 shows a portion of a sliding gate valve 10 at an outlet of a vessel containing molten metal. Only an outer steel shell 13 and a refractory sleeve brick 17 of the vessel are shown. This vessel is preferably a ladle, which may be filled with molten steel, for a continuous casting installation. A refractory sleeve 11 defines a discharge opening 12 from this vessel. Closely adjoining this sleeve 11 is an upper valve plate 20, which is secured in a metal frame 14 of the sliding gate valve 10 and which cooperates with a movable valve plate 20 disposed beneath it. The lower valve plate 20 serves to open and close the valve 10 and is mounted for this purpose in a longitudinally movable slider unit constructed as a metal frame 15. in which a refractory discharge sleeve 16 adjoining the plate 20 is also mounted. This sliding gate valve 10 is constructed in a conventional manner and, therefore, will not be described in more detail below.

The valve plates 20 have a respective prefabricated, commonly deep drawn, stamped metal shell 21 and a plate 22 comprising a refractory ceramic material 28 mortared into the metal shell 21. The mortar 28 is introduced into the metal shell 21 in a plastic state and after the insertion of the refractory plate, the mortar 28 dries and holds the refractory plate firmly therein. These plates 20, which are separately fabricated as a unit, are then loosely inserted in its entirety into the metal frames 14, 15 and are held therein, at least in a direction of movement, by centering means or a centering device.

Figure 2:
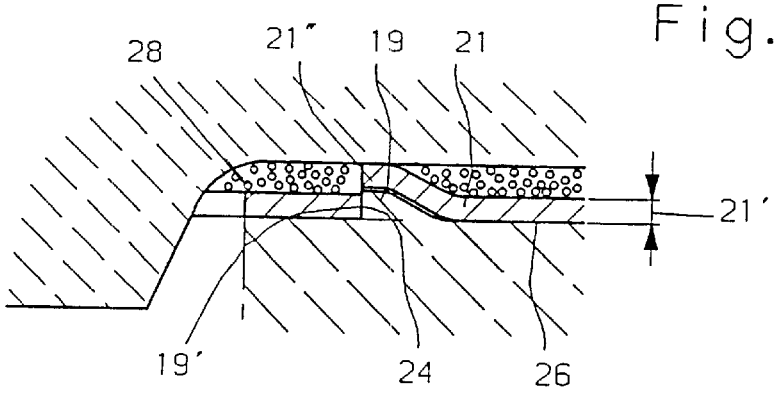
FIG. 2 is a longitudinal sectional view of the portion II of the valve plate in FIG. 1.
Figure 3:
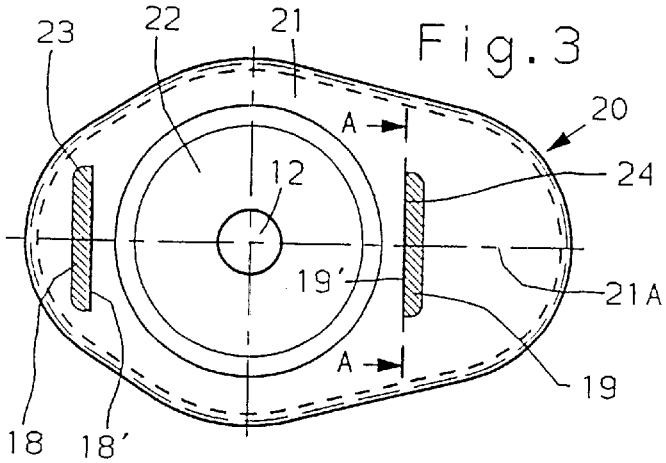
FIG. 3 is a plan view of the valve plate on the line III—III in FIG. 1.

As shown in FIG. 2 and FIG. 3, centering means or centering devices are associated with the valve plates 20 and, in accordance with the invention, are each preferably constituted by two abutment surfaces 23, 24 disposed at a defined spacing from one another. As shown in FIG. 2, these abutment surfaces 23, 24 rise up approximately vertical to a plate support 26 constituted by the metal shell 21 and they are each provided with a height approximately the same as a metal shell thickness 21'. In the inserted and centered state of the plates 20, these abutment surfaces 23, 24 engage correspondingly shaped abutment surfaces 18', 19' on the metal frames 14, 15 so that the plates 20 are held therein loosely and substantially clearance-free in the direction of movement. For this purpose, the metal frames 14, 15 have projecting noses 18, 19 with the respective abutment surfaces 18', 19'. These cooperating abutment surfaces 18', 19'and 23, 24 are constructed as perpendicular surfaces with respect to the plate support surface 26. The abutment surfaces 18', 19' and 23, 24 could also be somewhat dished or provided with a chamfer for simpler insertion of the plate into the frame.

In an advantageous construction, the metal shell 21 is provided with discontinuities and respective inwardly bent ribs 21" to define the abutment surfaces 23, 24. The edge produced in the metal shell 21 with this discontinuity accordingly defines the corresponding abutment surface 23, 24 which is exposed by the rib 21". The rib 21" is bent inwardly out in such a way that below the edge of the rib 21" at the discontinuity, the rib 21" is arranged adjacent to the upper edge of the continuing metal frame without any space in between. The advantage is that no mortar 28 can permeate between the rib 21" and the continuing metal frame and subsequently, the. abutment surface 23, 24 will not get dirty.

This rib 21" with the corresponding discontinuity may be fabricated in one working step due to the metal shell 21, which is produced by deep drawing. The tool mould accommodating the metal shell 21 and the die are so constructed that while the die is forced into the tool mould, the metal shell 21 is deep drawn in trough shape and is severed at the position. The abutment surface 23, 24 produced with this deep drawing process can be provided with a precise dimensional tolerance in the tenths of a millimeter range without special post-machining. Such a valve plate may thus, be equipped with this centering means or centering device described above in a very simple manner.

As shown in FIG. 3, these two straight, elongated abutment surfaces 23, 24 extend on the rear surface of the plate 20 at right angles to a longitudinal axis 21A of the plate 20. The abutment surfaces 23, 24 are disposed at the same distance from the discharge opening 12 and are provided with a length approximately equal to half the breadth of the plate 20 and are so dimensioned that pressure forces produced in the operating state on the abutment surfaces 23, 24 of the metal shell 21 are absorbed without deformation.

With this arrangement, one abutment surface 23 is formed on one side while the other abutment surface 24 is formed on the opposite side of the discharge opening 12 and consequently, between the abutment surfaces 23, 24, a distance is provided that is more than the half the length of the plate 20. Further, that the abutment surfaces 23, 24 of the plates 20 extend outwardly away, in accordance with the invention, a further advantage arises with regard to the mounting of the plates 20 into the respective metal frame 14, 15. The plates 20 are at room temperature in a cold condition before mounting, while the metal frames 14, 15 of the sliding gate valve 10 mounted on the vessel normally have a temperature of approximately 200° to 300° Celsius because of the previous operation. Due to this difference of temperature, the plates 20 can be easily put into the respective metal frame 14, 15, because the distance between the abutment surfaces 23, 24 of the plates 20 to those of the metal frames 14, 15 are some tenth of millimeters smaller than if no difference of temperature existed. After the mounting of the sliding gate valve 10 on the vessel and the filling of molten metal into this vessel 10, the plates 20, as well as the metal frames 14, 15 heat up to the same temperature, of e.g., at about 300 to 400° C. As a result, the plates 20 extend in opposition relative to the metal frames 14, 15 and become clamped in the metal frames 20 to a certain degree.

Figure 3A:
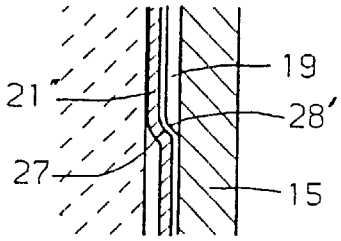
FIG. 3A is a cross-sectional view of the valve plate on the line A—A in FIG. 3.

FIG. 3A is a scrap sectional view of the centering of the plate 20 in the metallic frame 15 transverse to the longitudinal axis 21 A of the plate 20. It may be seen that the rib 21" is formed at a uniform spacing from the plate support 26 and that the refractory plate 22 engages this rib 21", preferably on its inner surface. In addition to a parallel alignment, this makes a defined distance between the refractory plate 22 and the support 26 possible. Furthermore, the nose 19 on the metal frame and the rib 21" are each provided with such a length that the rib 21" is arranged on both sides with its ends 27 with little clearance from an outer surface 28' of the nose 19 in the inserted state of the plate 20, so that the plate 20 is also centered to a certain extent transversely to the longitudinal axis 21A of the plate 20.

The valve plates of the exemplary embodiments described below and shown in FIG. 4 to FIG. 10 are constructed similarly to the plate 20 described in detail above. Only the differences or their specific constructions will, therefore, be explained below. The refractory plates 22 are preferably each mortared into the sheet metal shell.

Figure 4:
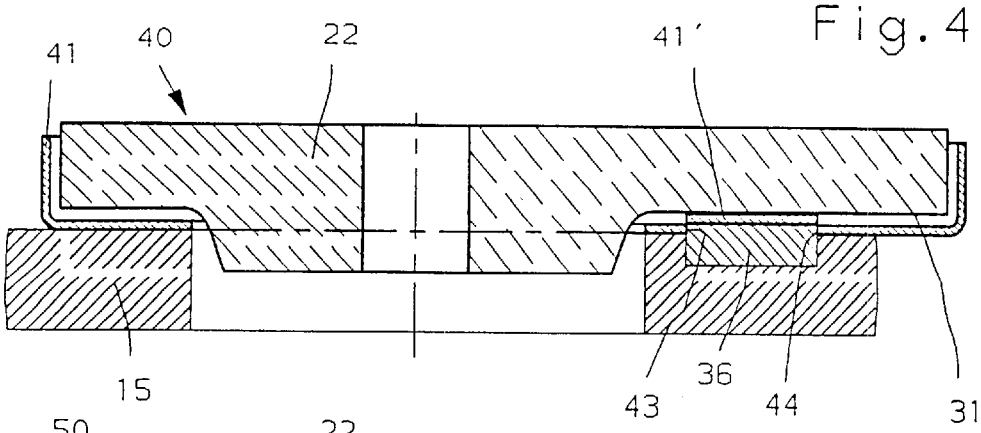
FIGS. 4, 5, 6, 7, 8 and FIG. 9 are longitudinal sectional views showing respective modifications of a valve plate in accordance with the invention.

FIG. 4 shows a valve plate 40 with centering means or devices in accordance with the invention in which two abutment surfaces 43, 44 are defined next to one another by a strip-shaped, inwardly bent rib 41' on a metal shell 41. This rib 41' is defined laterally by two discontinuities in the metal shell 41 and arranged on one side of the plate support surface. The metal frame 15 has a correspondingly constructed rectangular nose 36 on which respective abutment surfaces are present laterally and which correspond to those on the plate 40.

Figure 5:
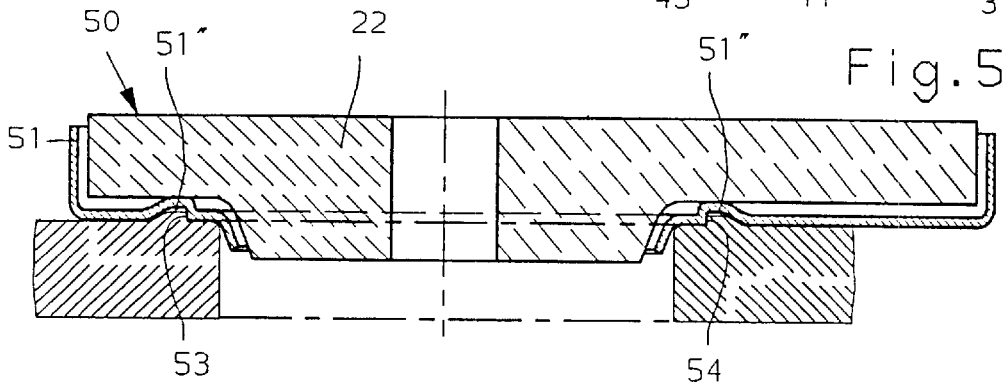

The valve plate 50 shown in FIG. 5 differs from the plate 20, which is shown in detail in FIG. 2 and FIG. 3, only in that discontinuities are not provided at the ribs 51" to define abutment surfaces 53, 54, but are instead impressed in the manner of grooves into a metal shell 51.

Figure 6:
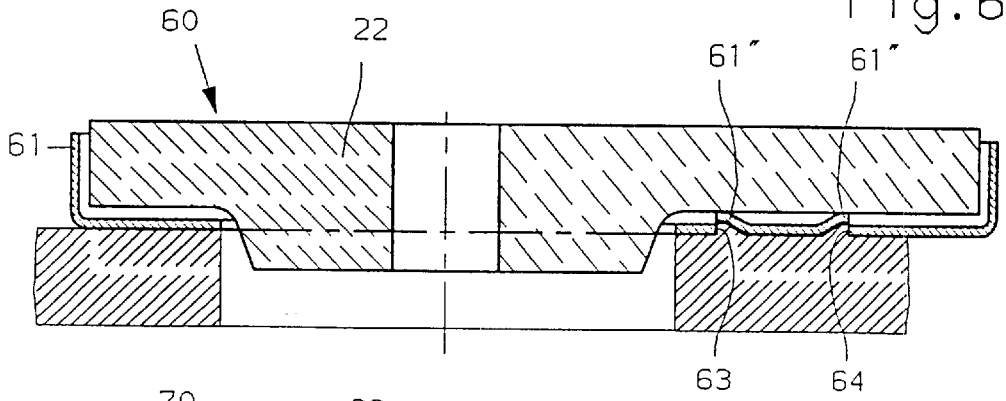

FIG. 6 shows a valve plate 60 with a metal shell 61 in which, in order to define abutment surfaces 63, 64, two ribs 61" are provided in a manner analogous to that in FIG. 2, but with a difference that both ribs 61" on a longer side of the support surface are arranged parallel to one another.

Figure 7:
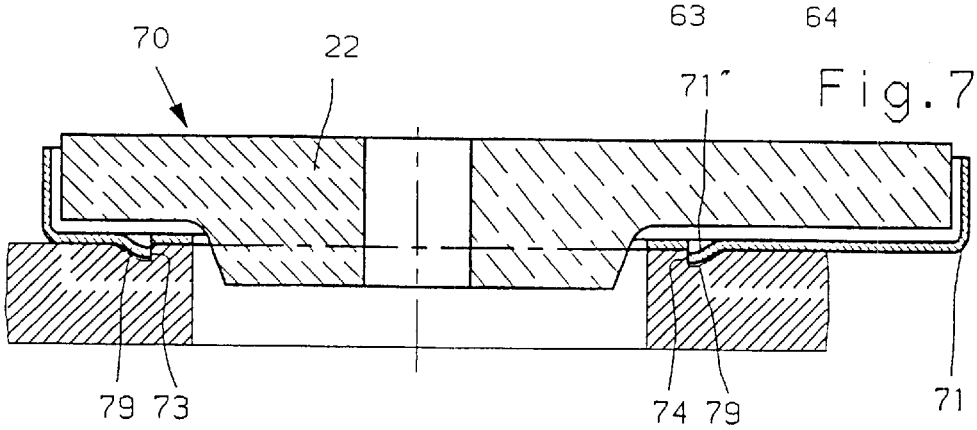

FIG. 7 shows a valve plate 70 in which the centering means or centering device, in accordance with the invention, is again constructed as ribs 71" provided in a metal shell 71, as illustrated in FIG. 3. However, these ribs project away from the plate 22. The abutment surfaces 73, 74 are correspondingly afforded by the end surfaces on the ribs 71", while the abutment surfaces on a metal frame are afforded by elongate grooves 79 formed therein.

Figure 8:
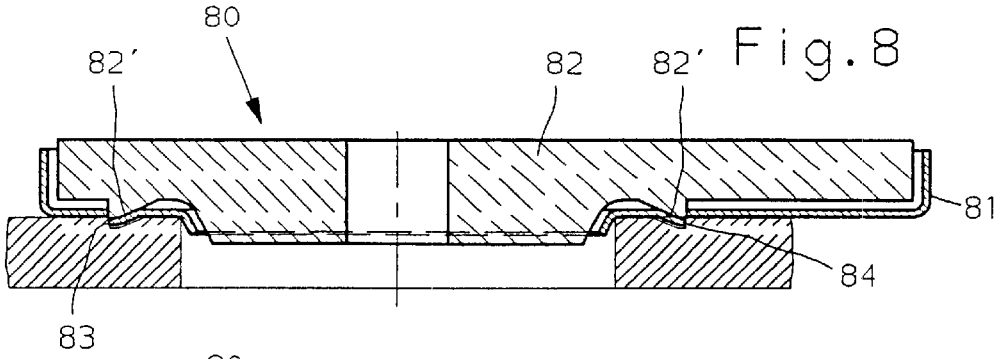

FIG. 8 shows a valve plate 80 which is provided with abutment surfaces 83, 84. The valve plate 80 differs from that shown in FIG. 7 merely in that a refractory plate 82 is provided with tooth-shaped thickened portions 82' which project into recesses in a metal shell 81 formed by bending away the ribs.

Figure 9:
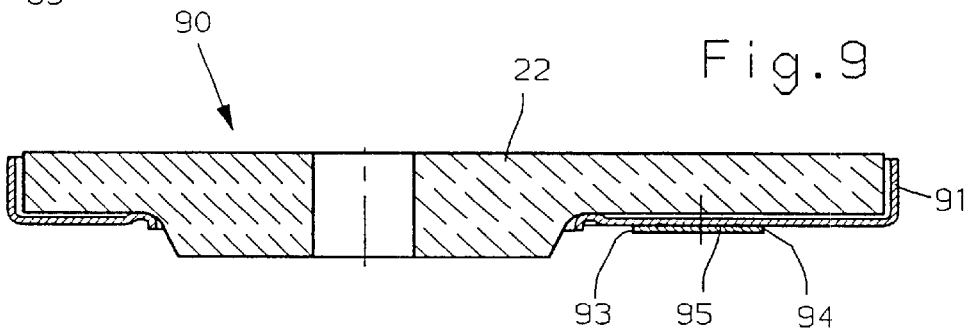

In a valve plate 90 shown in FIG. 9, the abutment surfaces 93, 94 are afforded by a metal strip 95 which is secured, particularly by spot welding, to the underside of a metal shell 91. This metal strip 95 is preferably of rectangular shape and has lateral edges, which serve as the abutment surfaces 93, 94, that are arranged at right angles to a longitudinal axis of the plate 90.

Figure 10:
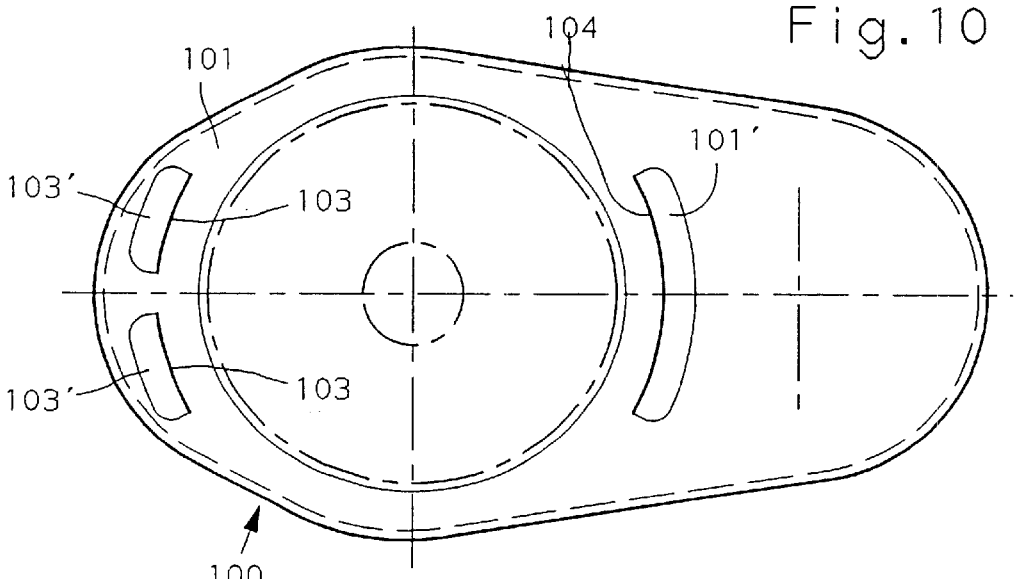
FIG. 10 is a plan view of a valve plate modification.
Figure 10A:
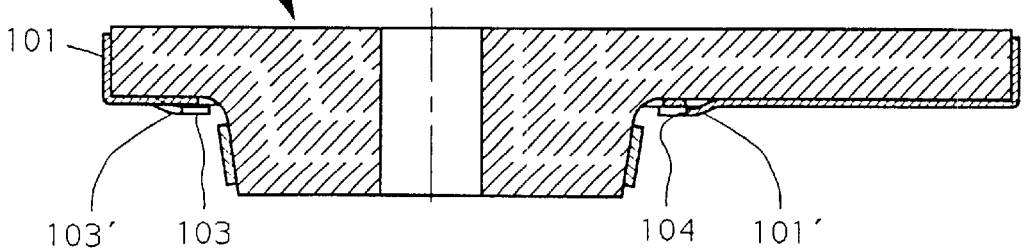
FIG. 10A is a longitudinal sectional view of the valve plate of FIG. 10.

FIG. 10 and FIG. 10A show a further construction of a valve plate 100 in which abutment surfaces 103, 104 have downwardly bent ribs 101', 103'. These abutment surfaces 103, 104 are distinguished by their circular shape, whereby the circle defined by them is concentric with a discharge opening in the plate. It is thereby ensured that this opening is precisely centered in the metal frame of the sliding gate valve and thus, the openings in the two valve plates are arranged concentrically with one another. On the side of the plate 100 with the smaller engagement surface, there are two ribs 103' arranged symmetrically with respect to a longitudinal axis of the plate, while on the opposite side, a rib 101' is included in a metal shell 101. These abutment surfaces could also be provided with a different shape instead of being of a straight line or circular shape.

These abutment surfaces provided on the underside of the plate are advantageously formed directly on the metal shell for the purpose of simple manufacturing. In principle, they could, however, also be provided directly on the refractory plate 22, particularly if the refractory plate 22 were to rest in a known manner directly on the metal frame 15 and no metal shell was provided between them, but only a band laterally surrounding the plate. The abutment surfaces would then be included directly in the refractory plate 22, by virtue of one or two recesses on the underside of the refractory plate 22.

What is claimed is:

1. A valve plate comprising:

a refractory plate;

a metal shell having a plate support, said metal shell surrounding a portion of said refractory plate; and a centering device comprising at least two abutment surfaces that are engagable with at least two correspondingly shaped abutment surfaces of a metal frame, said at least two abutment surfaces of said centering device being arranged at a defined spacing from each other on said plate support, and said at least two abutment surfaces of said centering device at least partially rising vertically transverse to a longitudinal axis of said valve plate and having a thickness approximately equal to a thickness of said metal shell, wherein said valve plate is loosely insertable into the metal frame, such that when said valve plate is inserted into the metal frame, said at least two abutment surfaces of said centering device engage the at least two correspondingly shaped abutment surfaces of the metal frame and said valve plate is centered in at least one direction with respect to the metal frame.

2. A valve plate according to claim 1, wherein said valve plate has a discharge opening, a first abutment surface of said at least two abutment surfaces of said centering device is formed on one side of the discharge opening, and a second abutment surface of said at least two abutment surfaces of said centering device is formed on an opposite side of the discharge opening.

3. A valve plate according to claim 1, wherein said valve plate has a discharge opening, a distance between said at least two abutment surfaces of said centering device is at least approximately half of a length of said valve plate, and said at least two abutment surfaces of said centering device extend outward away from the discharge opening.

4. A valve plate according to claim 1, wherein said at least two abutment surfaces of said centering device are elongated and extend on an underside of said valve plate traverse to the longitudinal axis of said valve plate, said at least two abutment surfaces of said centering device having lengths substantially equal to half of a breadth of said valve plate such that a force produced on said at least two abutment surfaces of said centering device in an operational state can be absorbed without deformation of said metal shell.

5. A valve plate according to claim 1, wherein said metal shell has at least two discontinuities and, respectively, at least two ribs bent inwardly out from said valve plate, and said at least two discontinuities and said at least two ribs respectively form said at least two abutment surfaces of said centering device.

6. A valve plate according to claim 5, wherein said at least two ribs are bent inwardly out such that lower edges of said at least two ribs respectively at said at least two discontinuities are adjacent to an upper edge of said metal frame without any space in between.

7. A valve plate according to claim 5, wherein said refractory plate engages said at least two ribs.

8. A valve plate according to claim 1, wherein said metal shell has at least two discontinuities and, respectively, at least two ribs projecting away from said valve plate, and said at least two abutment surfaces of said centering device are respectively provided at ends of said at least two ribs.

9. A valve plate according to claim 5, wherein said at least two ribs are dimensioned with respect to at least two noses that form the at least two correspondingly shaped abutment surfaces on the metal frame such that said valve plate is centered in a longitudinal direction of said valve plate and a direction transverse to the longitudinal direction of said valve plate.

10. A valve plate according to claim 1, further comprising at least one metal strip secured to said metal shell on a side of said plate support, wherein end edges of said at least one metal strip form said at least two abutment surfaces of said centering device.

11. A sliding gate valve comprising:

at least one metal frame having at least two abutment surfaces;

at least one valve plate comprising a refractory plate, and a metal shell having a plate support, said metal shell surrounding a portion of said refractory plate; and a centering device comprising at least two abutment surfaces that are engagable with said at least two abutment surfaces of said at least one metal frame that are correspondingly shaped, said at least two abutment surfaces of said centering device being arranged at a defined spacing from each other on said plate support, and said at least two abutment surfaces of said centering device at least partially rising vertically transverse to a longitudinal axis of said at least one valve plate and having a thickness approximately equal to a thickness of said metal shell, wherein said at least one valve plate is loosely insertable into said at least one metal frame, such that when said at least one valve plate is inserted into said at least one metal frame, said at least two abutment surfaces of said centering device engage said at least two abutment surfaces of said at least one metal frame and said at least one valve plate is centered in at least one direction with respect to said at least one metal frame.

12. sliding gate valve according to claim 11, wherein said at least one metal frame has one of projecting noses and elongated grooves that define said at least two abutment surfaces of said at least one metal frame.

13. A valve plate according to claim 2, wherein said valve plate has a discharge opening, a distance between said at least two abutment surfaces of said centering device is at least approximately half of a length of said valve plate, and said at least two abutment surfaces of said centering device extend outward away from the discharge opening.

14. A valve plate according to claim 2, wherein said at least two abutment surfaces of said centering device are elongated and extend on an underside of said valve plate traverse to the longitudinal axis of said valve plate, said at least two abutment surfaces of said centering device having lengths substantially equal to half of a breadth of said valve plate such that a force produced on said at least two abutment surfaces of said centering device in an operational state can be absorbed without deformation of said metal shell.

15. A valve plate according to claim 3, wherein said at least two abutment surfaces of said centering device are elongated and extend on an underside of said valve plate traverse to the longitudinal axis of said valve plate, said at least two abutment surfaces of said centering device having lengths substantially equal to half of a breadth of said valve plate such that a force produced on said at least two abutment surfaces of said centering device in an operational state can-be absorbed without deformation of said metal shell.

16. A valve plate according to claim 13, wherein said at least two abutment surfaces of said centering device are elongated and extend on an underside of said valve plate traverse to the longitudinal axis of said valve plate, said at least two abutment surfaces of said centering device having lengths substantially equal to half of a breadth of said valve plate such that a force produced on said at least two abutment surfaces of said centering device in an operational state can be absorbed without deformation of said metal shell.

17. A valve plate according to claim 2, wherein said metal shell has at least two discontinuities and, respectively, at least two ribs projecting away from said valve plate, and said at least two abutment surfaces of said centering device are respectively provided at ends of said at least two ribs.

18. A valve plate according to claim 3, wherein said metal shell has at least two discontinuities and, respectively, at least two ribs projecting away from said valve plate, and said at least two abutment surfaces of said centering device are respectively provided at ends of said at least two ribs.

19. A valve plate according to claim 4, wherein said metal shell has at least two discontinuities and, respectively, at least two ribs projecting away from said valve plate, and said at least two abutment surfaces of said centering device are respectively provided at ends of said at least two ribs.

20. A valve plate according to claim 13, wherein said metal shell has at least two discontinuities and, respectively, at least two ribs projecting away from said valve plate, and said at least two abutment surfaces of said centering device are respectively provided at ends of said at least two ribs.

* * * * *